US008667820B2

(12) United States Patent
King

(10) Patent No.: US 8,667,820 B2
(45) Date of Patent: Mar. 11, 2014

(54) LOCK MECHANISM FOR FIXING A SLIDE BAR IN EITHER OF TWO POSITIONS

(75) Inventor: Robert R. King, Elverson, PA (US)

(73) Assignee: Metro Industries Inc., Reno, NV (US)

( * ) Notice: Subject to any disclaimer, the term of this patent is extended or adjusted under 35 U.S.C. 154(b) by 241 days.

(21) Appl. No.: 13/001,166

(22) PCT Filed: Jun. 26, 2009

(86) PCT No.: PCT/US2009/048899
§ 371 (c)(1),
(2), (4) Date: Jan. 11, 2011

(87) PCT Pub. No.: WO2009/158639

PCT Pub. Date: Dec. 30, 2009

(65) Prior Publication Data

US 2011/0109209 A1 May 12, 2011

Related U.S. Application Data

(60) Provisional application No. 61/076,493, filed on Jun. 27, 2008.

(51) Int. Cl.
*E05B 47/06* (2006.01)

(52) U.S. Cl.
USPC ..... 70/278.7; 70/279.1; 70/281; 70/283.1; 70/DIG. 20; 70/DIG. 27; 70/DIG. 42; 70/DIG. 80; 292/140; 292/181; 292/DIG. 27; 292/DIG. 62

(58) Field of Classification Search
USPC ..... 70/277, 278.7, 279.1, 280–283, 283.1, 70/DIG. 42, DIG. 20, DIG. 27, DIG. 80, 70/78–81, 106, 111, 422, 472, 488, 149, 70/150, 151 R, 151 A, 153, 380; 292/144, 292/181, DIG. 62, 153, 182, 179, 140, 292/DIG. 27
See application file for complete search history.

(56) References Cited

U.S. PATENT DOCUMENTS 1,526,968 A * 2/1925 Elwell ..... 292/181
2,786,701 A * 3/1957 Povlich ..... 292/144

(Continued)

FOREIGN PATENT DOCUMENTS

CN 1594811 A 3/2005
CN 1641175 A 7/2005

OTHER PUBLICATIONS

State Intellectual Property Office of the People's Republic of China, Notification of the First Office Action [in Application No. 200980124472.5 corresponding to the subject application], Apr. 3, 2013.

*Primary Examiner* — Lloyd Gall
(74) *Attorney, Agent, or Firm* — Fitzpatrick, Cella, Harper & Scinto

(57) ABSTRACT

A lock mechanism for manually or automatically fixing a slide bar in either of two positions. A lock body has a key barrel adapted to rotate a lock cam in a first rotational direction. A latch is biased in a closed position, the latch being adapted to move to an open position when the lock cam is rotated in the first rotational direction. A slide bar is fixable in a locked position and an unlocked position, wherein the slide bar is biased in the unlocked position. A knob slider is adapted to move the slide bar into the locked position such that the latch moves to the closed position and engages a notch of the slide bar to fix the slide bar in the locked position. A servo motor is adapted to rotate a servo cam in a second rotational direction to move the slide bar into the locked position, and is adapted to rotate the lock cam in the first rotational direction to move the slide bar into the unlocked position. The key barrel is adapted to rotate in the first rotational direction to move the slide bar into the unlocked position. The lock mechanism can be made smaller, more compact, less expensive, have fewer parts, and be easier to manufacture.

26 Claims, 8 Drawing Sheets

(56) References Cited

U.S. PATENT DOCUMENTS

| | | | | | |
|---|---|---|---|---|---|
| 3,163,033 | A | * | 12/1964 | Boyles | 70/100 |
| 3,947,060 | A | * | 3/1976 | Zimmer et al. | 292/142 |
| 4,099,752 | A | * | 7/1978 | Geringer | 292/144 |
| 4,643,006 | A | * | 2/1987 | Bron | 70/107 |
| 4,745,785 | A | * | 5/1988 | Uebersax | 70/279.1 |
| 4,840,050 | A | * | 6/1989 | Gotanda | 70/107 |
| 4,902,053 | A | * | 2/1990 | Hakkarainen et al. | 292/144 |
| 5,004,287 | A | * | 4/1991 | Doyle | 296/57.1 |
| 5,029,912 | A | * | 7/1991 | Gotanda | 292/143 |
| 5,199,288 | A | * | 4/1993 | Merilainen et al. | 70/279.1 |
| 5,546,777 | A | * | 8/1996 | Liu et al. | 70/257 |
| 6,045,169 | A | * | 4/2000 | Frolov | 292/332 |
| 6,418,763 | B1 | * | 7/2002 | Huang | 70/278.7 |
| 6,511,138 | B1 | | 1/2003 | Gardner et al. | 312/217 |
| 6,813,916 | B2 | * | 11/2004 | Chang | 70/257 |
| 6,964,183 | B2 | | 11/2005 | Keightley | 70/279.1 |
| 7,240,524 | B1 | * | 7/2007 | White et al. | 70/257 |
| 7,775,072 | B2 | * | 8/2010 | Pullmann et al. | 70/208 |
| 2006/0144102 | A1 | | 7/2006 | Keightley | 70/279.1 |
| 2007/0113602 | A1 | | 5/2007 | Watts | 70/107 |

* cited by examiner

LOCK MECHANISM FOR FIXING A SLIDE BAR IN EITHER OF TWO POSITIONS

BACKGROUND OF THE INVENTION

1. Field of the Invention

This invention relates to a lock mechanism assembly having automatic and manual locking procedures for locking drawers in a cabinet, and more generally to an improved lock mechanism for fixing a slide bar in either of two positions.

2. Description of the Related Art

There are many examples of manual or automatic means for locking drawers in a cabinet. One type of cabinet for which locking drawers can be especially important is a medical supply cart. A medical supply cart commonly contains medical equipment, instruments, and supplies that are necessary for treating patients in the hospital. Security of such items can be particularly important to prevent unauthorized dispensing or use of such items.

A supply cart generally includes a housing having a plurality of drawers, shelves, and/or compartments for storing the medical equipment and supplies. The housing is typically supported by a plurality of wheels or casters so that it may be moved from its place of storage to the location of the patient. To provide security of the items contained therein, supply carts typically have a security latch mechanism for simultaneously securing all compartments of the cart in a sealed condition.

One example of a drawer closing and latching mechanism is disclosed in U.S. Pat. No. 6,511,138 to Gardner et al. As discussed in that patent, drawers which are slightly ajar are grasped by the latching mechanism, pulled fully closed, and locked shut. A latch finger engages a catch connected to the drawer and pulls the drawer closed. The finger is actuated by a crankshaft which, as it rotates, first lowers the latch finger to capture the catch, and then retracts the latch finger and with it the captured drawer. The crankshaft rotates to a position where any pull forces on the finger are nearly in line with the axis of the crankshaft and have little tendency to cause reverse rotation. The crankshaft is then retained in this position, effectively locking the drawer closed.

While prior art systems such as that disclosed in the Gardner patent are generally good for their intended purposes, the current state of the art of such conventional lock mechanisms would benefit from improvements in a number of respects. For example, there is a need for an improved lock mechanism that is smaller and simpler, with fewer parts, that is less expensive, and the operation of which is highly reliable.

SUMMARY OF THE INVENTION

The present invention provides an improved lock mechanism for fixing a lock block or slide bar in either of two positions. The slide bar may be, in turn, coupled to a lock mechanism that locks and unlocks drawers or other compartments of a supply cart. The lock mechanism according to the present invention can be smaller, more compact, less expensive, and have fewer parts. Therefore, the lock mechanism is highly reliable in operation. The lock mechanism according to the present invention can also be simpler to manufacture. One reason for this is that the lock mechanism can be comprised of less complex pieces that are, for example, injection molded.

In accordance with one aspect, the lock mechanism of the present invention includes a housing, a slide bar mounted in the housing for translational movement between a first position and a second position, a first biasing spring for exerting a bias force against the slide bar toward the second position, and a slide bar actuator mounted in the housing for urging the slide bar toward the first position against the force exerted by the first biasing spring. A latch is also mounted in the housing and is movable between a first position in which it holds the slide bar in the first position when moved thereto, and a second position in which the latch releases the slide bar permitting it to move to the second position thereof under the force exerted by said first biasing spring.

A second biasing spring exerts a force on the latch and a cam is rotatably mounted in the housing and has a lobe engagable with the latch for, upon rotation in one direction, urging said latch to its second position thereby releasing said slide bar to move to the second position.

According to a further aspect of the present invention, there is provided a lock mechanism for manually or automatically fixing a slide bar in either of two positions. A latch is biased to a closed position, to hold the slide bar in one position, namely, a locked position, the latch being adapted to move to an open position when a lock cam is rotated by a key barrel in a first rotational direction to release the slide bar. The slide bar is fixable in the locked position, but biased toward the unlocked position. A knob slider, which is connected to the slide bar through a lost motion coupling, is adapted to move the slide bar manually into the locked position such that the latch moves to the closed position and engages a notch of the slide bar to fix the slide bar in the locked position. A servo motor is provided and may be optionally controlled to be operable to rotate a servo cam in the one rotational direction also to move the slide bar into the locked position, and is also further operable to rotate the servo cam in an opposite direction to move the latch to the open position.

The latch may be biased toward the closed position by a spring. The slide bar may be biased toward the unlocked position also by a spring. The lock mechanism may further comprise a plurality of positioning screws to define a range in which the slide bar can slide, opposing ends of the range corresponding to the locked position and the unlocked position, respectively. The lock mechanism may further comprise a knob adapted to actuate the knob slider. The servo motor may be controlled by a controller.

According to another aspect of the present invention, there is provided a lock mechanism having a locked mode and an unlocked mode. A lock block is adapted to slide between a first position and a second position, the lock block being biased to the second position. A lock block actuator is operable to slide the lock block from the second position to the first position. A servo motor is adapted to rotate a servo cam in a first direction also to move the lock block from the second position to the first position. In the unlocked mode the lock block is in the second position and in the locked mode the lock block is in the first position.

The lock mechanism may further comprise a latch that is biased toward a closed position, the latch being adapted to move to an open position when the servo cam is rotated in a second direction. When the knob slider moves the lock block from the second position to the first position, the latch moves to the closed position and engages a notch in the lock block to fix the lock block in the first position.

A better understanding of these and other aspects, features, and advantages of the invention may be had by reference to the drawings and to the accompanying description, in which preferred embodiments of the invention are illustrated and described.

DETAILED DESCRIPTION OF THE PREFERRED EMBODIMENTS

Figure 1:
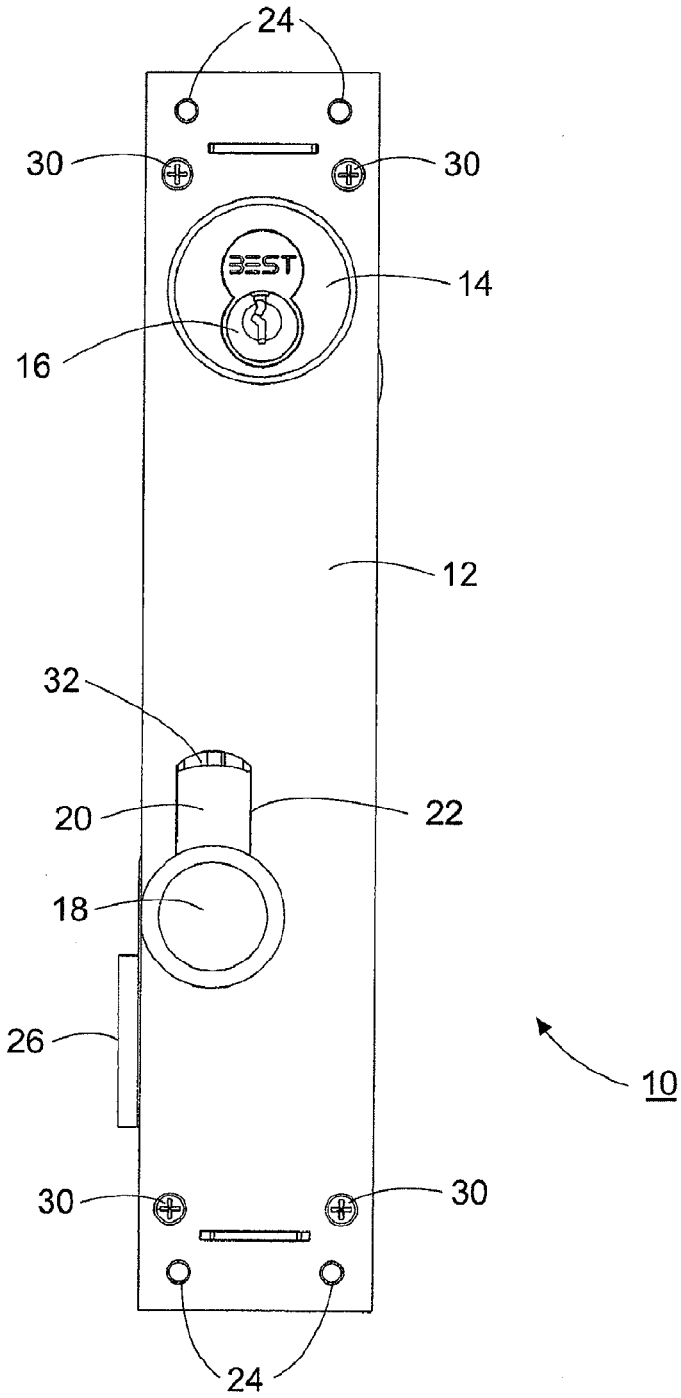
FIG. 1 is a front view of a lock mechanism for fixing a slide bar in either of two positions according to one embodiment of the present invention.

An exemplary embodiment of the present invention will be discussed with reference to the accompanying figures. According to this embodiment of the present invention, a lock mechanism has a lock block or slide bar which can be fixed in either of two positions: a first lowermost (locked) position and a second uppermost (unlocked) position. It is of course to be understood that the directional terms used in this description, such as "lowermost" and "uppermost," are merely for explanatory purposes relative to the views shown in the drawings, and are not meant to limit the orientation of the lock mechanism of the present invention in any way. The present invention according to this embodiment has both automatic and manual procedures for fixing the slide bar in the locked position.

Figure 7:
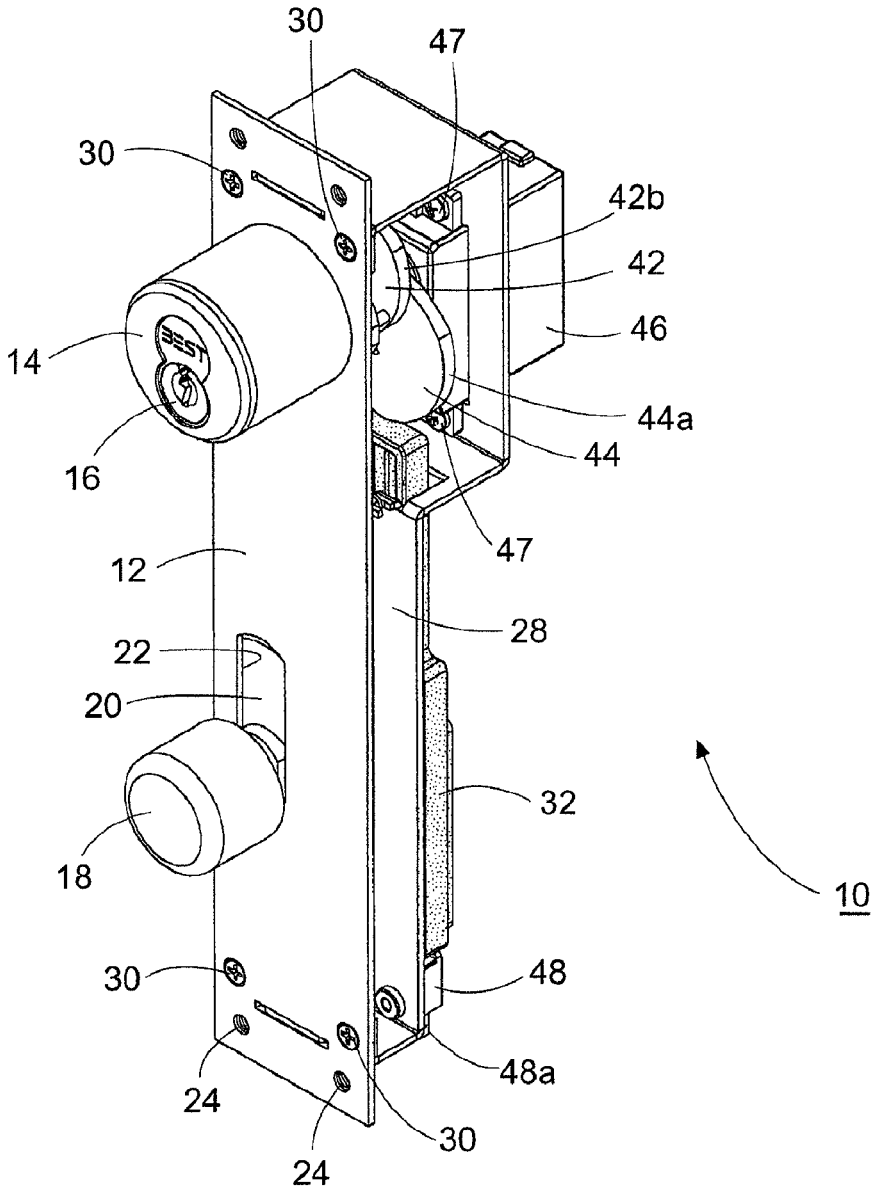
FIG. 7 is a perspective view of the lock mechanism shown in FIG. 1 taken from the right and above.

FIG. 1 and FIG. 7 are respectively a front view and a perspective view of a lock mechanism 10 according to the exemplary embodiment of the present invention. As can be seen there, lock mechanism 10 has a front plate 12, preferably made of metal, on which is mounted a mechanical lock body 14 having a barrel 16 for receiving a key (not shown). A knob 18 is attached to and moves together with a knob slider 20, the knob 18 having a post 18*a* that projects through and is slidable in a front plate slot 22 at least during a locking procedure described below. A plurality of self-clinching nuts 24 are adapted to receive screws for securing the lock mechanism 10 to an apparatus that is to be locked, such as a medical supply cart. A lock tab connector 26 is provided to couple the lock mechanism to a corresponding lock mechanism (not shown) in the cart to operate it to lock and unlock, for example, drawers in the cart.

Figure 2:
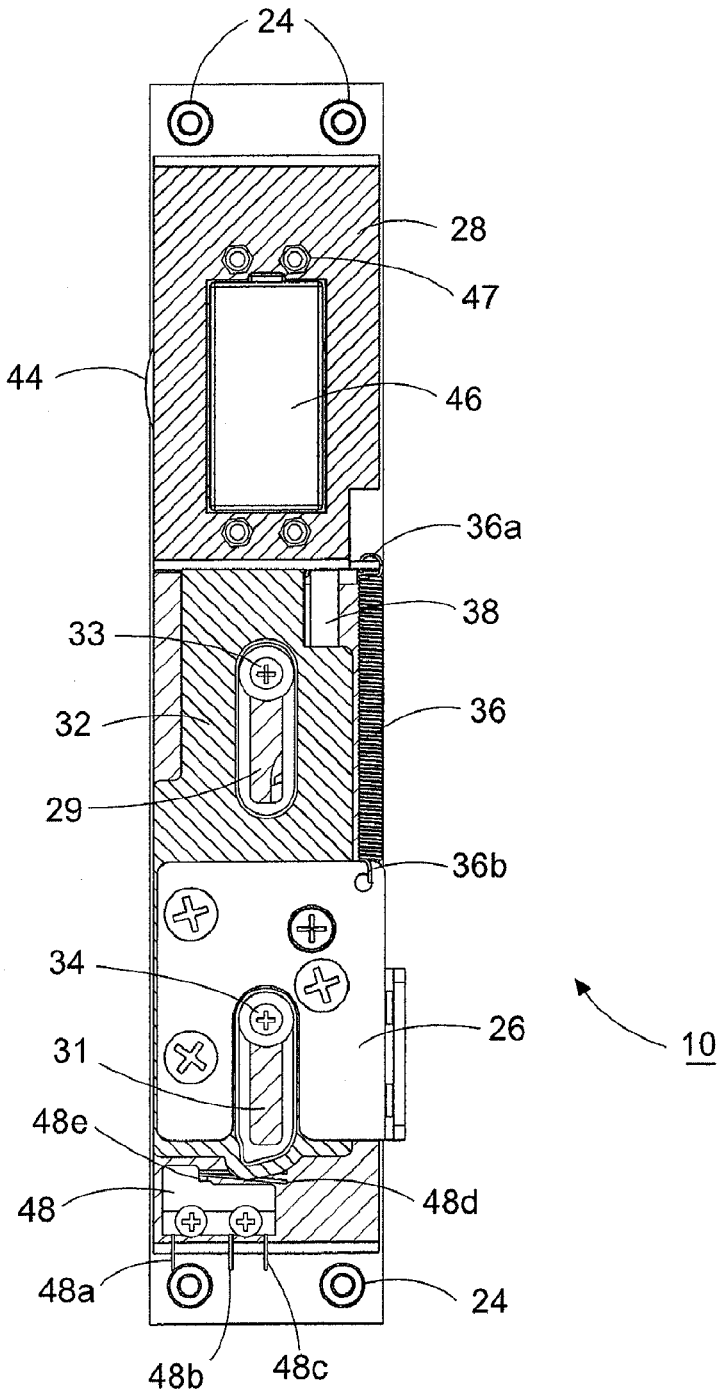
FIG. 2 is a back view of the lock mechanism shown in FIG. 1.
Figure 8:
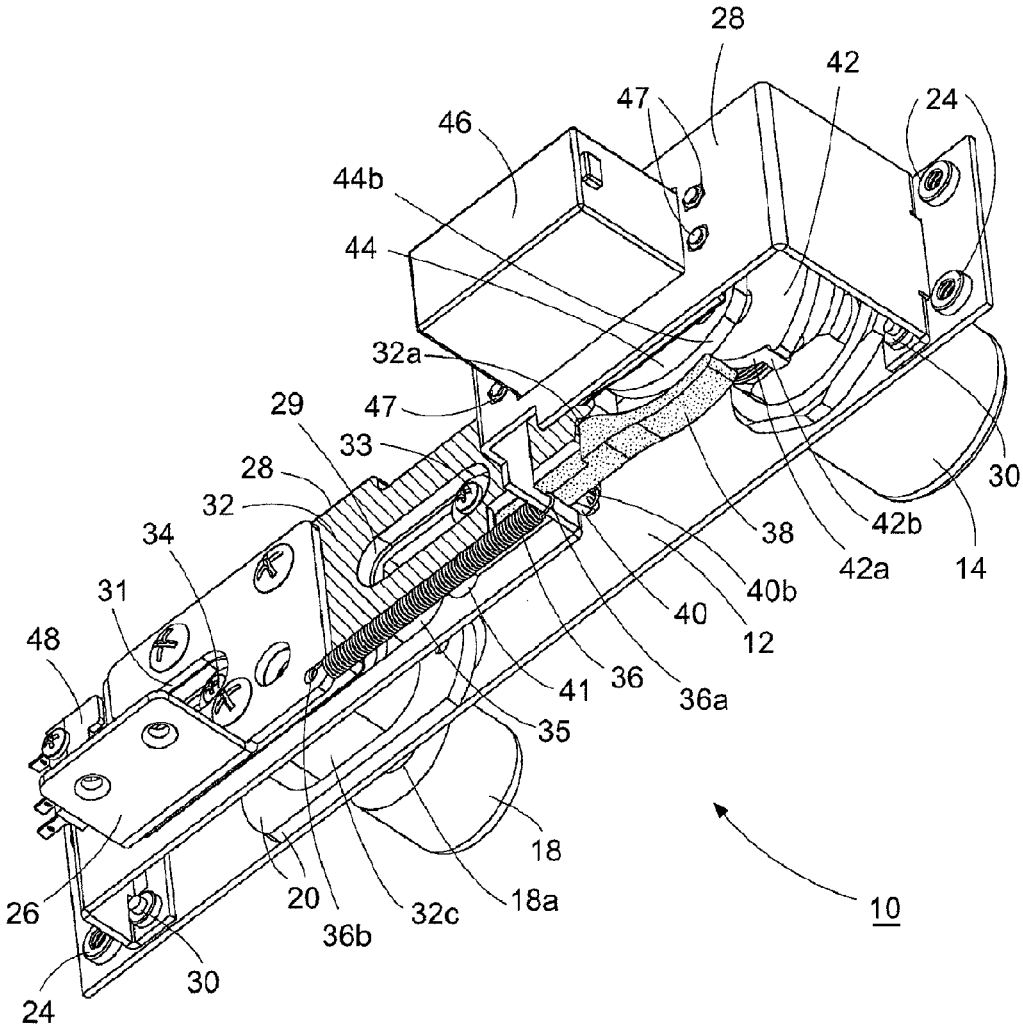
FIG. 8 is a left perspective view of the lock mechanism shown in FIG. 1 taken from the left and above.

FIG. 2 and FIG. 8 are respectively a back view and a perspective view of the lock mechanism 10 in accordance with the preferred embodiment. As can be seen further there, the lock mechanism 10 also has a back plate 28, preferably made of metal, which is secured to the front plate 12 via a plurality of screws 30. The front plate 12 and back plate 28 may be considered together to define a housing. A lock block or slide bar 32, mounted for translational movement on the back plate 28 as described in greater detail below, is coupled to the knob slider 20, as illustrated in more detail in the left side and right side views shown in FIGS. 3 and 4, respectively. The connector 26 is secured to the slide bar 32 such that its movement, as described below, controls locking and unlocking of the cart. The slide bar 32 is coupled to the knob slider 20 through a lost motion coupling such that the slide bar 32 can be pulled down by the knob slider 20 (via the knob 18) in a manual locking procedure described further below. However, if the knob slider 20 is pulled up (via the knob 18), the slide bar 32 does not follow. More specifically, a finger 32*b* projects from the slide bar 32 through a slot 35 (see FIGS. 3 and 8) of the back plate 28 and is engaged with a recessed channel 32*c* of the knob slider 20. When the knob slider 20 is pulled down (via the knob 18), the top of the recessed channel forces the engaged finger 32*b* downwardly. When the knob slider 20 is pulled up, the upper edge of the slot 22 in the front plate 12 engages the knob post 18*a* to stop the knob 18, and, therefore, stops the knob slider 20 before the bottom of the recessed channel of the knob slider 20 would begin to force the engaged finger 32*b* upwardly.

The slide bar 32 also has two elongated slots 29, 31 for receiving positioning screws 33, 34 respectively. The positioning screws 33, 34 are secured to the back plate 28 and operate, along with the slots 29, 31, to mount the slide bar to the back plate and to define upper and lower limits of the range in which the slide bar 32 can move. The positioning screws 33, 34 preferably carry washers, as shown, to ease the sliding movement of the slide bar.

During the locking/unlocking procedures described herein, the slide bar 32 is movable between two positions, i.e., a first lowermost (locked) position and a second uppermost (unlocked) position. A tension spring 36, the ends 36*a* and 36*b* of which are respectively connected to the back plate 28, and slide bar 32 through the lock bar connector 26, biases the slide bar 32 in the upward direction toward the second position.

In the locked position, as shown for example in the perspective view of FIG. 8, the slide bar 32 is fixed in the lowermost position by a latch 38, which is mounted for pivoted, inward and outward movement about a pivot pin 41. The latch 38 engages an upper notch 32*a* in the slide bar 32 when the slide bar 32 is in the locked position. The latch 38, therefore, fixes the slide bar 32 in the lowermost (locked) position by preventing upward movement of the slide bar 32 against the biasing of the spring 36. A second tension spring 40, having ends 40*a* and 40*b* respectively connected to the back plate 28 and the latch 38, biases the latch 38 inwardly so that the latch 38 will engage the notch 32*a* when the slide bar is moved to the locked position.

As described above, when locked the slide bar 32 is fixed in the lowermost position. When unlocked, the slide bar 32 is fixed in the uppermost position. The unlocking procedure is as follows.

If the slide bar 32 is in the locked position, a user can effect the unlocking procedure by inserting a key into the barrel 16 of the lock body 14 and turning the key counterclockwise (when viewed from the front of the lock mechanism 10), for example. Thus turning the key causes a lock cam 42 connected for rotation with the lock barrel mechanism also to turn counterclockwise. The lock cam has a lobe 42*a* that engages the latch 38 and forces it to move outwardly away from engagement with the upper notch of the slide bar 32, i.e., causes the latch 38 to move against the bias of the spring 40. As this action occurs, the slide bar 32 is released from its lowermost position and is pulled to the uppermost (unlocked) position by the spring 36, where it remains fixed until the next locking action. The lock cam 42 may also be formed with a stop 42*b* that blocks over-rotation of the cam.

Manual and automatic locking procedures according to the present invention are next described. In order to manually lock the lock mechanism 10, a user may pull down on the knob 18. In so doing, the knob slider 20, which is connected to both the knob 18 and the slide bar 32 as described above, forces the slide bar 32 downwardly. When the slide bar 32 is forced to the lowermost position, the latch 38 is pulled inwardly by the spring 40 and engages the notch 32*a* in the slide bar 32 as described above. This engagement prevents upward movement of the slide bar 32 until a subsequent unlocking procedure takes place and, thus, fixes the slide bar 32 in the locked position.

Figure 3:
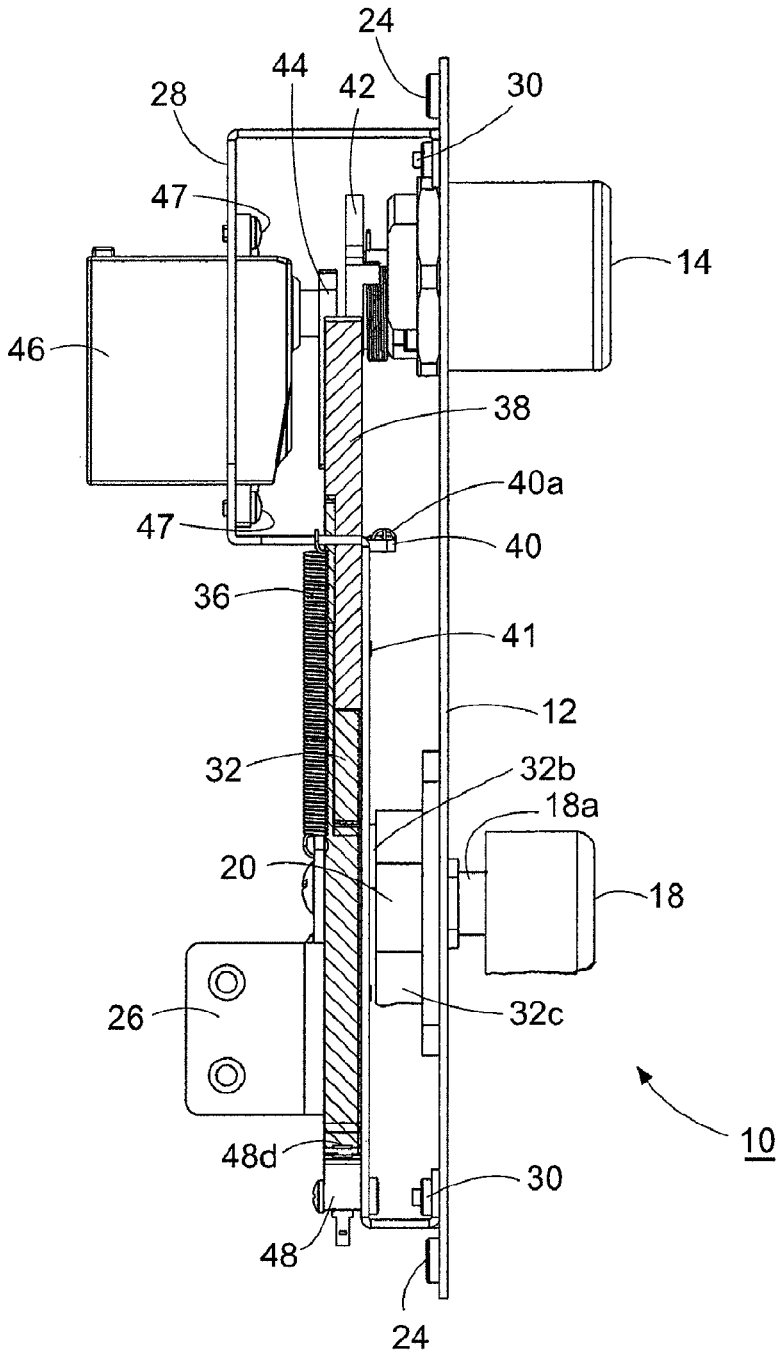
FIG. 3 is a left side view of the lock mechanism shown in FIG. 1.
Figure 4:
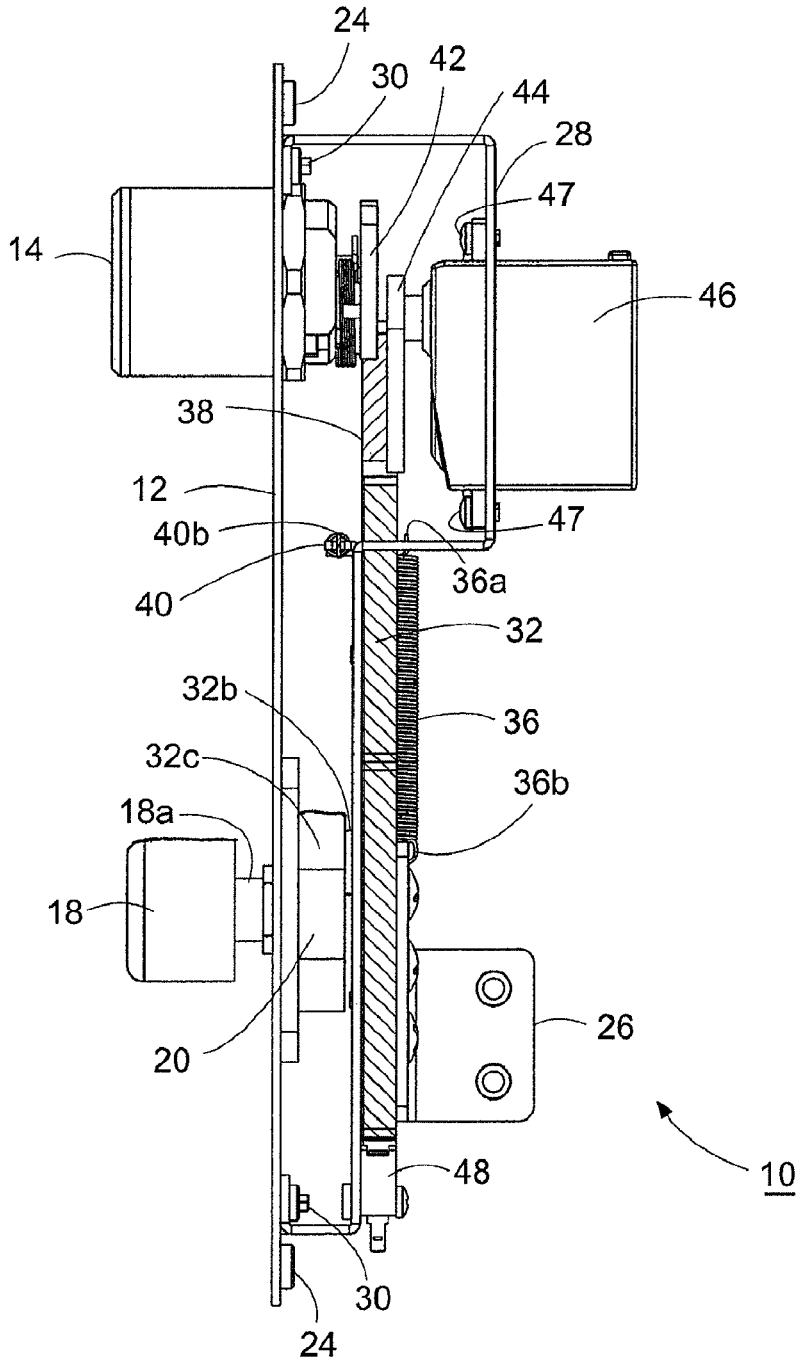
FIG. 4 is a right side view of the lock mechanism shown in FIG. 1.
Figure 5:
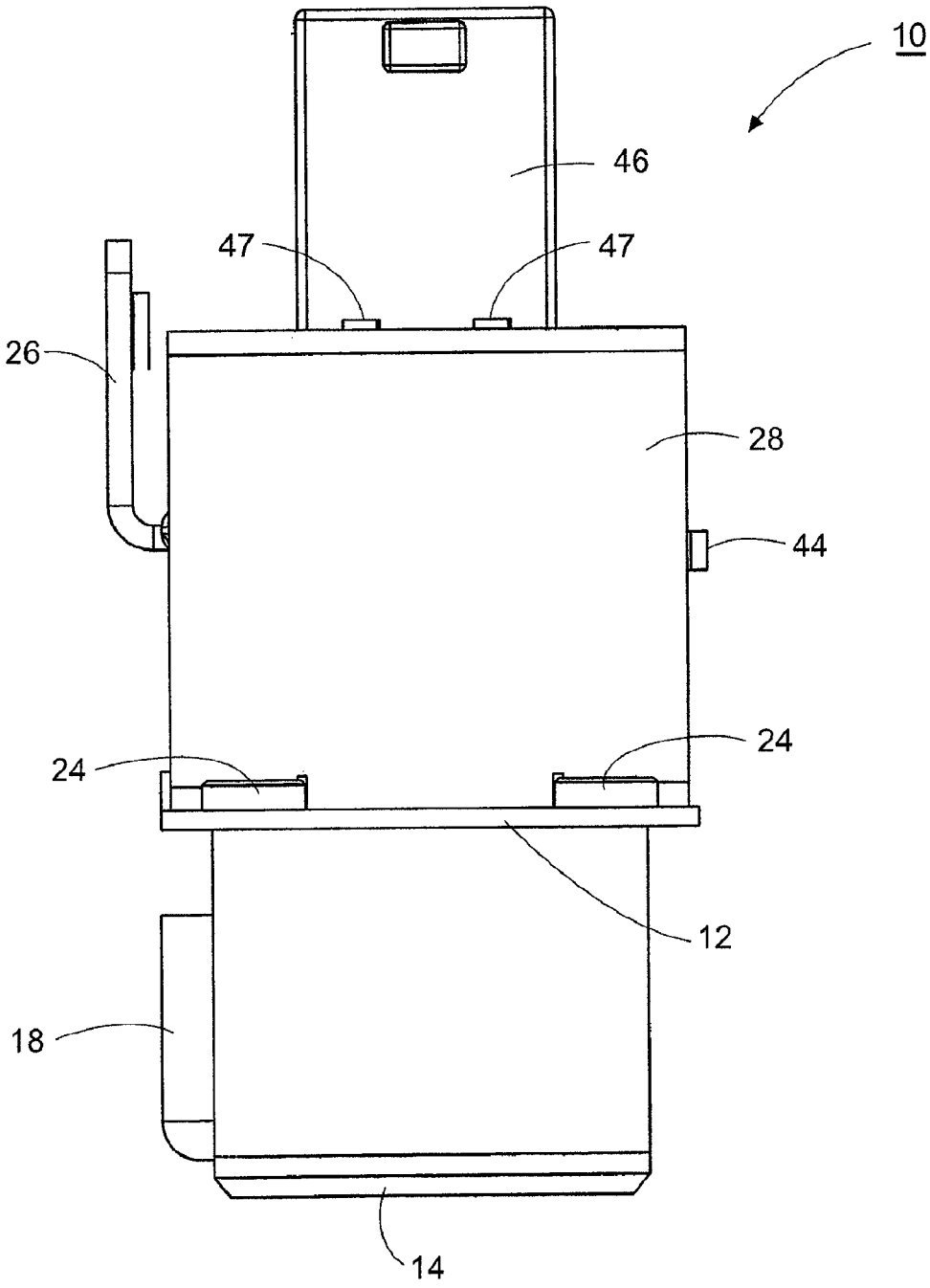
FIG. 5 is a top view of the lock mechanism shown in FIG. 1.
Figure 6:
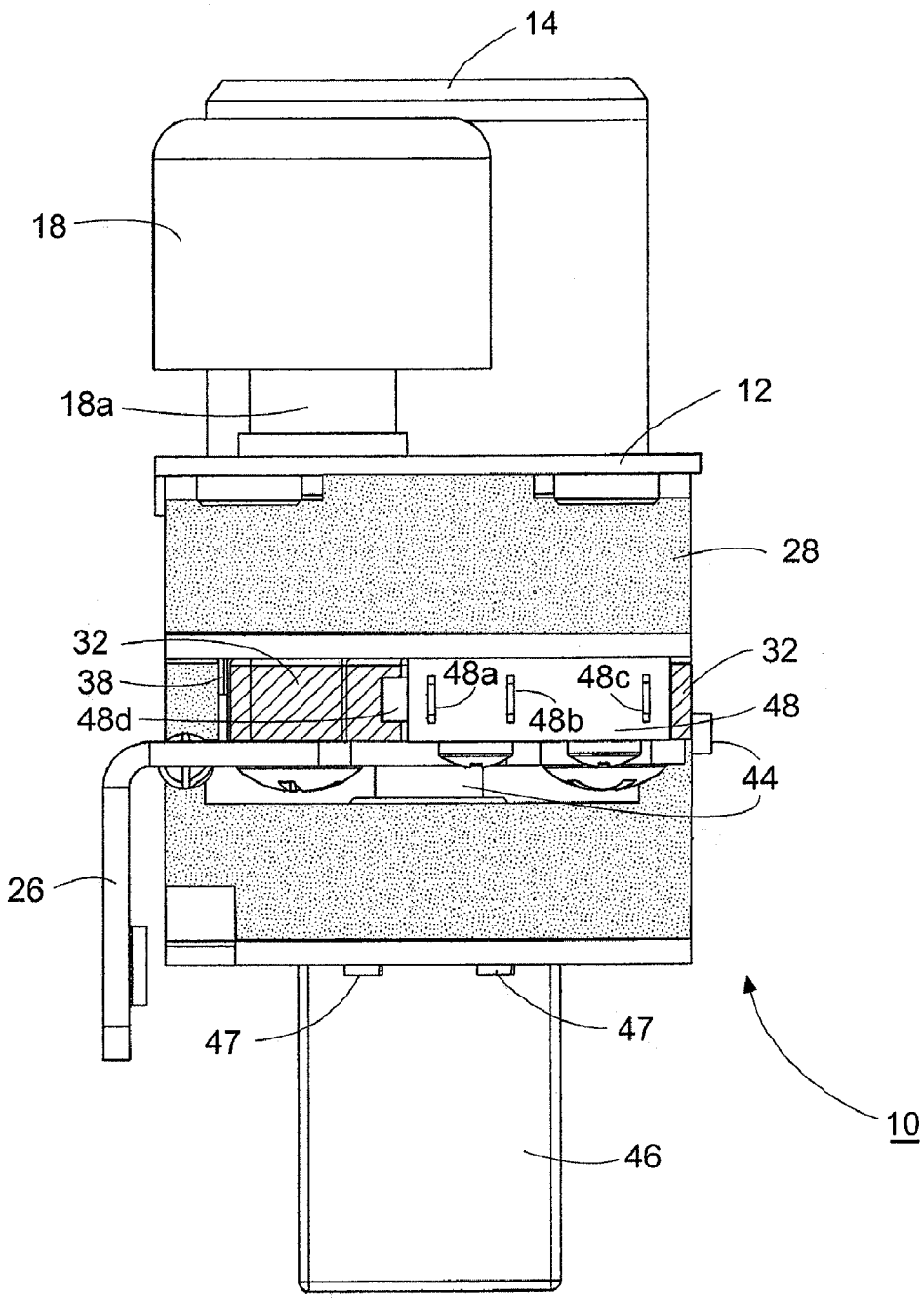
FIG. 6 is a bottom view of the lock mechanism shown in FIG. 1.

In addition, as shown in FIGS. 3 and 7, the lock cam optionally may be formed with a second lobe 42*b* that engages the top of the slide bar when the barrel 16 of the lock body 14 is turned clockwise through operation of the key. This action will then also advance the slide bar to the locked position.

Automatic locking of the lock mechanism in accordance with the invention may be provided by a servo actuator. More particularly, a servo cam 44 (see, e.g., FIG. 7) is mounted for rotation coaxially with the lock cam 42. When the slide bar 32 is in the uppermost (unlocked) position, the servo cam 44 may optionally be controlled to be rotated clockwise as seen from the front of the lock mechanism 10. The cam is formed with a lobe 44*a* that engages and thereby forces the top of the slide bar 32 downwardly through interaction between the two, fixing the slide bar 32 to the lowermost (locked) position. The servo cam 44 may then be returned to its initial position so that it does not interfere with the unlocking procedure (e.g., by keeping the slide bar 32 fixed in the locked position), and so that it is ready for the next locking procedure.

The servo cam 44 is controlled and driven by a servo motor 46, which is secured through an opening in the back plate 28 by way of a plurality of through-holes and screws 47. The servo motor 46 is electrically connected to an electronic controller (not shown) that may be located apart from the lock mechanism 10. A limit switch 48, having terminals 48*a, b, c*, is also connected to the electronic controller. When the lock mechanism 10 is locked, the bottom of the slide bar 32 contacts and trips an actuator or lever 48*d* to close the limit switch 48. A signal will thereby be sent to the controller to indicate that the slide bar 32 is in the lowermost position, and, therefore, that the lock mechanism 10 is locked. At this position, the servo motor is stopped to prevent further advance of the slide bar.

When the lock mechanism 10 is unlocked, the bottom of the slide bar 32 moves upwardly as described earlier and thereby permits the switch actuator 48*d* to open with the limit switch 48.

A control program causes the controller of the servo motor 46 to control the servo cam 44 with respect to various locking schemes according to the "autolock" mode of the present invention. For example, the servo motor 46 can be controlled to rotate the servo cam 44 to move the slide bar 32 into the locked position in response to a code input by an operator through a keypad (not shown), or after the lock mechanism 10 has been unlocked for a predetermined time period. The servo motor 46 can still further be controlled to rotate the servo cam 44 to move the slide bar 32 into the locked position at a set time of day. Suitable control schemes are known and available, for example, in commercial cart locking systems available form Lionville Systems, Inc. and identified as LockAlert and LockAlert VI. Thus, as is apparent, the servo motor 46 can be programmed to effect various autolocking schemes.

The control program in the controller of the servo motor 46 can also direct the servo motor 46 to rotate the servo cam 44 to effect the unlocking procedure. Specifically, the servo motor 46 can be controlled to rotate the servo cam 44 clockwise. The cam includes a second lobe 44*b* which then forces the latch 38 to move away from engagement with the notch 32*a* of the slide bar 32, i.e., causes the latch 38 to move against the biasing of the spring 40. As this action occurs, the slide bar 32 is released from its lowermost position and is pulled to the uppermost (unlocked) position by the spring 36. The controller of the servo motor 46 can be programmed to effect the unlocking procedure, for example, in response to a code input by an operator through a keypad, at a set time, or after the lock mechanism 10 has been locked for a predetermined time period. Again such programming schemes are known or are within the skill of the art.

The controller of the present invention or any part(s) or function(s) thereof may be implemented using hardware and software and may be implemented in one or more computer systems or other processing systems. It is noted that the servo motor 46 may be controlled by one or more modules contained in the controller. The modules can operate in accordance with software control programs and operating routines stored in an associated memory or memories. The modules and their sub-modules can write and/or read information to/from the memory or memories, and in this way, can perform operations in accordance with the present invention. The modules may be implemented using hardcoded computational modules or other types of circuitry, or a combination of software and circuitry modules. Software routines for performing the modules can, in one embodiment, be stored as instructions in a memory and can be executed by a processor of a control module.

The software may be stored in a computer program product, a computer program medium, or a computer-readable medium, and loaded into a computer system using a removable storage drive, a hard drive, or a communications interface. The control logic (software), when executed by a processor, causes the processor to perform the automated functions of the invention as described herein.

In this document, the terms "computer program medium" and "computer usable medium" are used to refer generally to media such as a removable storage drive, a hard disk installed in a hard disk drive, and signals. Also, "computer-readable medium" is used to refer generally to media such as a storage drive, CD, hard drive or other tangible objects that can store a program. These computer program products provide software to the system.

It will be appreciated from the description provided above and the accompanying drawings that the front and back plates, slide bar, latch and lock and servo cams are all relatively thin or narrow in their minor dimensions or extents, and that in their respective major dimensions or extents extend in substantially parallel planes. Therefore, the lock mechanism in accordance with the present invention is very compact.

In addition, the invention lock mechanism has few moving parts. Therefore, it is highly reliable and can be made efficiently and inexpensively.

While the present invention has been designed with a cabinet or medical supply cart in mind, the present invention is not limited to such, but could be used for locking other types of devices, in commercial or non-commercial settings.

One of ordinary skill in the art will realize that modifications and variations, including but not limited to those discussed above, are possible within the spirit and scope of the present invention. The invention is intended to be limited in scope only by the accompanying claims, which should be accorded the broadest interpretation so as to encompass all such modifications, equivalent structures and functions.

What is claimed is:

1. A lock mechanism comprising:

a housing;

a slide bar mounted in said housing for translational movement between (a) a first position and (b) a second position;

a first biasing means for exerting a bias force on said slide bar urging it toward the second position thereof, a latch mounted in said housing and movable between (a) a first position in which said latch holds said slide bar in the first position thereof when moved thereto, and (b) a second position in which said latch releases said slide bar permitting it to move to the second position thereof under the force exerted by said first biasing means;

second biasing means for exerting a bias force on said latch urging it toward the first position thereof;

a first cam rotatably mounted in said housing and having a lobe engagable with said latch for, upon rotation of said first cam, urging said latch to the second position thereby releasing said slide bar to move to the second position; and a user-operated control mechanism operable from the exterior of said housing, said control mechanism being manually movable in a first direction, which causes the slide bar to move to the first position, and in an opposite direction, which does not cause the slide bar to move to the second position.

2. The lock mechanism as set forth in claim 1, further comprising operating means for moving said slide bar to the first position, wherein moving said user-operated control mechanism in the first direction causes the operating means to engage in moving the slide bar to the first position, and wherein moving said user-operated control mechanism in the opposite direction causes the operating means to disengage from moving said slide bar to the first position.

3. The lock mechanism as set forth in claim 2, further comprising lost motion coupling means for coupling said operating means to said slide bar.

4. The lock mechanism as set forth in claim 3, wherein said lost motion coupling means comprises a channel in said operating means, wherein said slide bar includes a projection engagable with said channel, wherein a first end of the channel engages with the projection when said operating means moves said slide bar to the first position.

5. The lock mechanism as set forth in claim 1, further comprising a second cam rotatably mounted in said housing having a lobe engagable with said latch for, upon rotation of said second cam, urging said latch to the second position thereby releasing said slide bar to move to the second position.

6. The lock mechanism as set forth in claim 5, further comprising means for independently operating said first and second cams.

7. The lock mechanism as set forth in claim 6, wherein said means for operating at least one of said cams comprises a mechanical lock coupled to at least one of said cams.

8. The lock mechanism as set forth in claim 7, wherein said mechanical lock comprises a barrel coupled to said second cam.

9. The lock mechanism as set forth in claim 7, wherein said mechanical lock is key-operated and said lock mechanism further comprises a key engagable with said mechanical lock.

10. The lock mechanism as set forth in claim 7, wherein said mechanical lock is coupled to said second cam.

11. The lock mechanism as set forth in claim 1, further comprising a servo motor coupled to said first cam.

12. The lock mechanism as set forth in claim 1, wherein said first biasing means comprises a spring connected in tension between said slide bar and said housing.

13. The lock mechanism as set forth in claim 1, wherein said second biasing means comprises a spring connected in tension between said latch and said housing.

14. The lock mechanism as set forth in claim 1, further comprising:

a servo motor coupled to said first cam; and control means for actuating said servo motor to operate said first cam.

15. The lock mechanism as set forth in claim 14, wherein said first cam is also engagable with said slide bar for, upon rotation of said first cam, urging said slide bar to the first position.

16. The lock mechanism as set forth in claim 15, wherein said control means comprises a limit switch mounted in said housing, engagable with said slide bar when said slide bar is moved to the first position thereof, thereby to deactivate said servo motor.

17. The lock mechanism as set forth in claim 5, wherein said second cam has a second lobe engagable with said slide bar for, upon rotation of said second cam, urging said slide bar toward said first position thereof.

18. The lock mechanism as set forth in claim 1, wherein said housing comprises a plate extending in one plane, and wherein each of said slide bar, said latch, and said first cam has a major extent in a plane that is substantially parallel with the plane of said plate.

19. A lock mechanism for manually or automatically placing a slide bar in either of two positions, comprising:

a lock body having a key barrel;

a lock cam coupled to said key barrel to be rotated thereby in a first rotational direction;

a slide bar having a notch and being placeable in a locked position and an unlocked position, wherein the slide bar is biased toward the unlocked position;

a latch biased toward a closed position, engagable with said notch of said slide bar, the latch being adapted to move to an open position when the lock cam is rotated in the first rotational direction;

a knob slider operable to move the slide bar to the locked position such that the latch may move to the closed position and engage the notch of the slide bar to fix the slide bar in the locked position;

a servo cam engagable with said slide bar; and a servo motor adapted to rotate said servo cam in a second rotational direction to move the slide bar into the locked position.

20. The lock mechanism as set forth in claim 19, wherein the key barrel is adapted to receive a key.

21. The lock mechanism as set forth in claim 19, further comprising biasing means for biasing the latch toward the closed position.

22. The lock mechanism as set forth in claim 19, further comprising biasing means for biasing the slide bar toward the unlocked position.

23. The lock mechanism as set forth in claim 19, further comprising a plurality of positioning screws for defining a range within which the slide bar can move, each end of the range corresponding to the locked position and the unlocked position, respectively.

24. The lock mechanism as set forth in claim 19, wherein said coupling of said lock cam to said key barrel further permits said lock cam to be rotated in the second rotational direction to move the slide bar into the locked position.

25. A lock mechanism having a locked mode and an unlocked mode, comprising:

a lock block adapted to slide between a first position and a second position, biasing means for biasing the lock block toward the second position;

a knob slider operable to slide the lock block from the second position to the first position;

releasable means for holding the lock block in the first position;

a servo cam engagable with the lock block;

a servo motor operable to rotate the servo cam to release said holding means thereby permitting said lock block to move from the first position to the second position, wherein in the unlocked mode the lock block is in the second position and in the locked mode the lock block is in the first position.

26. The lock mechanism as set forth in claim 25, wherein said releasable means comprises a latch for latching said lock block in the first position, biasing means for biasing the latch toward a closed position latching said lock block, the latch being mounted to move to an open position when the servo cam is rotated in a first rotational direction.

* * * * *